US005705064A

United States Patent [19]

Leupold

[11] Patent Number: 5,705,064

[45] Date of Patent: Jan. 6, 1998

[54] PERMANENT MAGNET RING SEPARATOR

[75] Inventor: Herbert A. Leupold, Eatontown, N.J.

[73] Assignee: The United States of America as represented by the Secretary of the Army, Washington, D.C.

[21] Appl. No.: 637,337

[22] Filed: Apr. 8, 1996

[51] Int. Cl.[6] ..... B01P 35/06

[52] U.S. Cl. ..... 210/222; 210/695; 335/306

[58] Field of Search ..... 210/222, 695; 335/306

[56] References Cited

U.S. PATENT DOCUMENTS 5,216,400 6/1993 Leupold ..... 335/306

5,466,574 11/1995 Liberti et al. ..... 210/222

*Primary Examiner*—David A. Reifsnyder

*Attorney, Agent, or Firm*—Michael Zelenka; William H. Anderson

[57] ABSTRACT

A magnetic particle separator for separating such things as ore or blood is made from a permanent magnet structure which has a plurality of segments combined to form a cylinder. Each of said plurality of segments has a magnetic remanence and direction that varies so as to form a transverse magnetic field gradient within the bore of the cylinder. A pipe is placed within the bore of the cylinder for transporting a material that is to be separated. An output end of the pipe has a transverse divider or web separating the pipe into a region near the lower magnetic flux density in the magnetic field gradient and a region near the higher magnetic flux density in the magnetic field gradient. Because of the magnetic field gradient within the bore of the pipe, the particles, having a magnetic moment or dipole, are caused to drift toward the higher magnetic flux density end of the magnetic field gradient. The web is used to separate the material into a material with a high density of particles and a material with a low density of particles. The particles are conveniently collected at the high density of particles output end.

9 Claims, 2 Drawing Sheets

PERMANENT MAGNET RING SEPARATOR

GOVERNMENT INTEREST

The invention described herein may be manufactured, used, imported, sold, and licensed by or for the Government of the United States of America without the payment to me of any royalty thereon.

FIELD OF THE INVENTION

This invention relates in general to magnetic devices having transverse magnetic field gradients, and more particularly to a cylindrical permanent magnet used to separate or concentrate particles having a magnetic moment or dipole.

BACKGROUND OF THE INVENTION

There are many processes in which it is desirable to separate or concentrate a mixture of particles having a magnetic moment. It is often desirable to separate magnetic species from mixes, suspensions, slurries, ores, or other materials. The separation of magnetic species or particles having a magnetic moment is particularly applicable to ore separators or medical applications, especially in blood research and diagnosis. It is often difficult to separate or concentrate these particles easily. It is especially difficult to separate the particles using a continuous process. Although various permanent magnet structures are known, such as the permanent magnet structures disclosed in U.S. Pat. No. 5,216,400 entitled "Magnetic Field Sources For Producing High Intensity Variable Fields" issuing to Leupold on Jun. 1, 1993, which is herein incorporated by reference, they have typically been applied to manipulating electromagnetic energy for communication devices. Therein disclosed is a permanent magnet structure, in one embodiment a sphere and in another embodiment a cylinder, capable of producing a tapering magnetic field in the cavity. Both the magnitude and the direction of the remanence of the magnetic material vary from segment to segment. These permanent magnet structures are capable of producing very high magnetic fields and magnetic field gradients. Accordingly, there is a need for an efficient and continuous process and device for separating particles having a magnetic moment or dipole.

SUMMARY OF THE INVENTION

The present invention is directed to a permanent magnet structure having a tubular cylindrical configuration producing a transverse magnetic field with a gradient along the field direction therein. A bore is formed within the cylindrical permanent magnet structure. The cylindrical permanent magnet structure is formed from a plurality of wedge shaped segments that have varying remanence and magnetic direction or orientation. The magnet segments are arranged with a magnetic direction and remanence to provide a magnetic field having a gradient transverse to the longitudinal axis of the cylindrical permanent magnet structure. A tube or pipe is placed within the tubular cylindrical permanent magnet structure. The permanent magnet structure forms a magnetic field gradient having a high magnetic flux density near one inner surface of the pipe and a lower magnetic flux density near an opposing inner surface of the pipe. The pipe having an input end and an output end is placed longitudinally within the permanent magnet structure. The output end of the pipe is divided longitudinally. One of the divided portions of the pipe is formed near or adjacent the lower magnetic flux density region and another portion of the divided pipe is formed near or adjacent the higher magnetic flux density region. Material or particles pumped from the input end of the pipe to the output end of the pipe travel down the pipe longitudinally or axially. The magnetic field gradient causes particles having a magnetic moment or dipole to drift or flow towards the higher magnetic flux density region of the transverse magnetic field gradient. A high density of particles or material is thereby formed near the higher magnetic flux density region at the output of the divided pipe.

Accordingly, it is an object of the present invention to separate magnetic particles or particles having a magnetic moment from another medium.

It is another object of the present invention to provide a region of higher density or concentration of particles.

It is an advantage of the present invention that the structure is relatively compact with few moving parts.

It is another advantage of the present invention that a continuous separation process may be achieved.

It is a feature of the present invention that a gradient field permanent magnet magic ring structure is utilized.

It is another feature of the present invention that a transverse magnetic field gradient is created.

It is yet a further feature of the present invention that a pipe is divided into a higher and lower magnetic flux density region at the output.

These and other objects, advantages, and features will become more readily apparent in view of the following more detailed description.

DETAILED DESCRIPTION OF THE PREFERRED EMBODIMENTS

Figure 1:
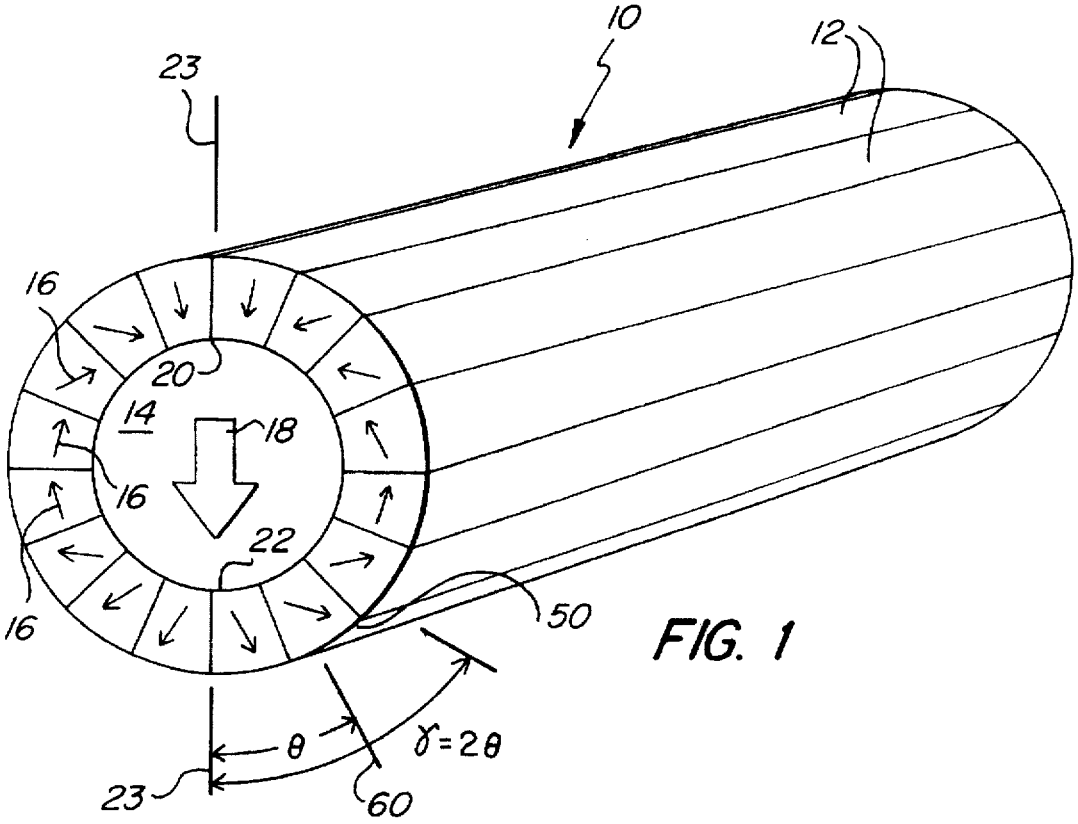
FIG. 1 is a schematic perspective view of a permanent magnet structure referred to as a magic cylinder and forming a hollow cylinder.

FIG. 1 is a perspective view illustrating a magic cylinder. The magic cylinder may be made of a plurality of magic rings. A magic cylinder is a permanent magnet structure such as that disclosed in U.S. Pat. No. 5,216,400, which is herein incorporated by reference. The hollow cylinder 10 is made of a plurality of wedge shaped permanent magnet segments 12. The segments 12 form a cylinder 10 having a bore 14. Arrows 16 on each of the segments 12 represent the remanence and the direction of magnetic orientation, with the head of the arrow 16 pointing north. The length of the arrow is proportional to the remanence. Accordingly, the remanence and direction of the magnetic orientation change for each segment 12. Therefore, a magnetic field is formed within the bore 14 represented by arrow 18. Additionally, because of the different remanences, a magnetic field gradient is formed from a lower magnetic flux density at surface 20 to a higher magnetic flux density at surface 22 opposite surface 20. Therefore, a transverse magnetic field gradient is formed within the bore 14 of cylinder 10. This magnetic field gradient or taper varies with progression from one magnetic pole to the other. The magnetic field can be made quite large and is dependent only upon the size of the permanent magnet cylinder. It is most efficient for the magnetization of the permanent magnet segments 12 to have a remanence that decreases linearly from a maximum to zero with progression along the polar axis. Additionally, it is desirable that the direction of magnetic orientation 16, of the cylinder sections 12 change linearly with progression along the azimuthal coordinate angle as $\gamma=2\theta$. This is illustrated in FIG. 1 for cylinder section 50 where $\theta$ represents the angle between central axis 23 and orientation angle 60 of cylinder section 50 and where $\gamma$ represents the desired angle of magnetization, represented by arrows 16, for cylinder section 50.

Figure 2:
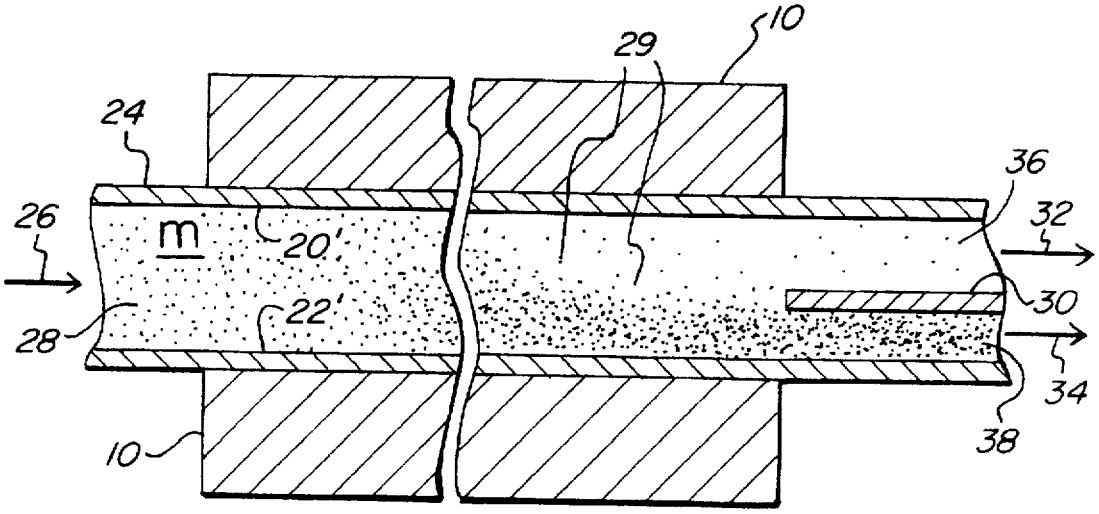
FIG. 2 is a longitudinal cross section of the present invention.

FIG. 2 is a cross section illustrating the present invention. The permanent magnet cylinder 10 has a tube or pipe 24 placed therein. Pipe 24 extends beyond both ends of the permanent magnet cylinder 10. Only a portion of the pipe 24 is illustrated. Pipe 24 may be relatively long and used as a conduit for material to flow through. Additionally, the pipe 24 is preferably made of a material that will readily transmit the magnetic field created by the permanent magnet cylinder 10. Arrow 26 represents the direction of material flow through pipe 24. Mixed material M is forced through one end of the pipe 24 at mixed material input 28. The mixed material M may be any mix, suspension, or slurry containing magnetic particles 29 or particles having a magnetic moment or dipole which are affected by a magnetic field gradient. The dipole may be either permanently fixed or field induced. Before entering the area surrounded by the permanent magnet cylinder 10, the magnetic particles 29 are substantially uniformly distributed throughout the material M. As the material M progresses down the pipe 24, it is subjected to the transverse magnetic field gradient created by the permanent magnet cylinder 10. The propelling force on a particle 29 with a moment is given by:

$$(\vec{m}\cdot\nabla)\vec{B}$$

where $\vec{m}$=magnetic moment or dipole $\vec{B}$=magnetic field strength

Since the moment increases with field, a high field is desirable where the magnetic field is induced by particle moments. Where the particles have fixed moments, then only the magnitude of the gradient is of any concern. In such cases, remanences of the wedges comprising the ring should be adjusted so that the field at the low field end is zero. The outer radius is then adjusted to obtain the desired gradient. Due to the magnetic field gradient, the particles 29 are propelled or caused to drift towards the surface 22' having the highest magnetic field gradient. Accordingly, as the mixed material M progresses from one end of the pipe 24 to the other, the particles 29 in the material M accumulate near the higher magnetic flux density surface 22'. A divider or web 30 placed at the output end of the pipe 24 separates the material into a low density particle or material output 36 and a high density particle or material output 38. Arrow 32 represents the direction of flow of the material having a low density of particles 29 and arrow 34 represents the directional flow of the material having a higher density of particles 29.

Figure 3:
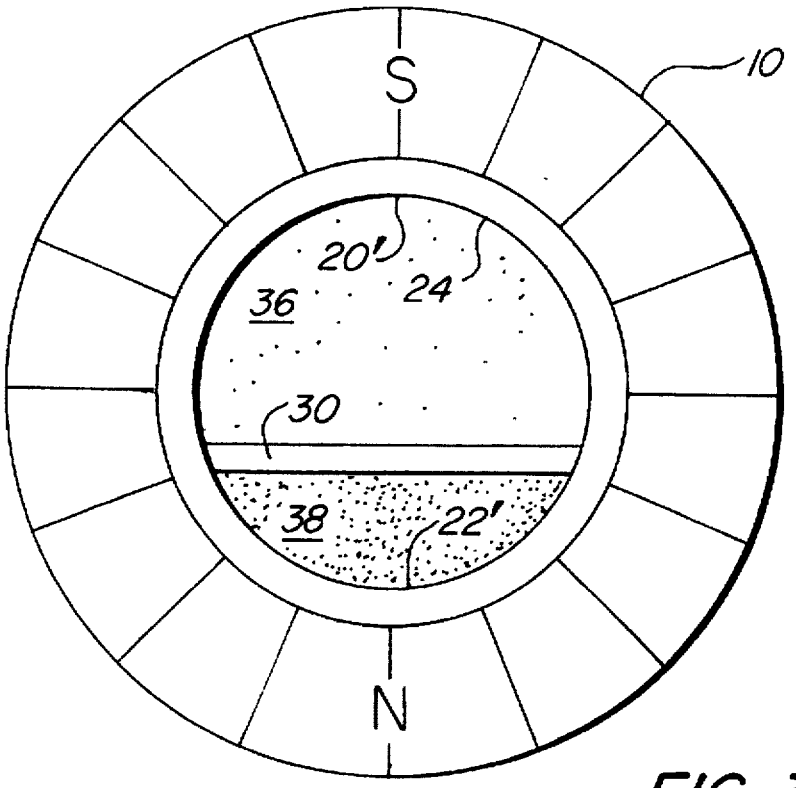
FIG. 3 is an end view of the present invention.

FIG. 3 is a front view illustrating the output end of the present invention. The surface 20' of pipe 24 near the south pole end of cylindrical permanent magnet 10 has a relatively low magnetic flux density near surface 20'. Opposing surface 22' is adjacent the north pole of cylindrical permanent magnet 10 and has a relatively high magnetic flux density near surface 22'. The web 30 bisects or divides the interior of pipe 24 into two portions, a low density particle or material output portion 36 and a high density particle or material output portion 38. The divider or web 30 extends transversely perpendicular to the direction of magnetic field. Additionally, the web or divider 30 extends longitudinally within the pipe 24 to a distance near the end of the permanent magnetic cylinder 10, as illustrated in FIG. 2. The north and south poles may be reversed as long as the magnetic gradient remains. The particles will drift in the direction of the increasing magnetic field strength irrespective of the polarity.

Figure 4:
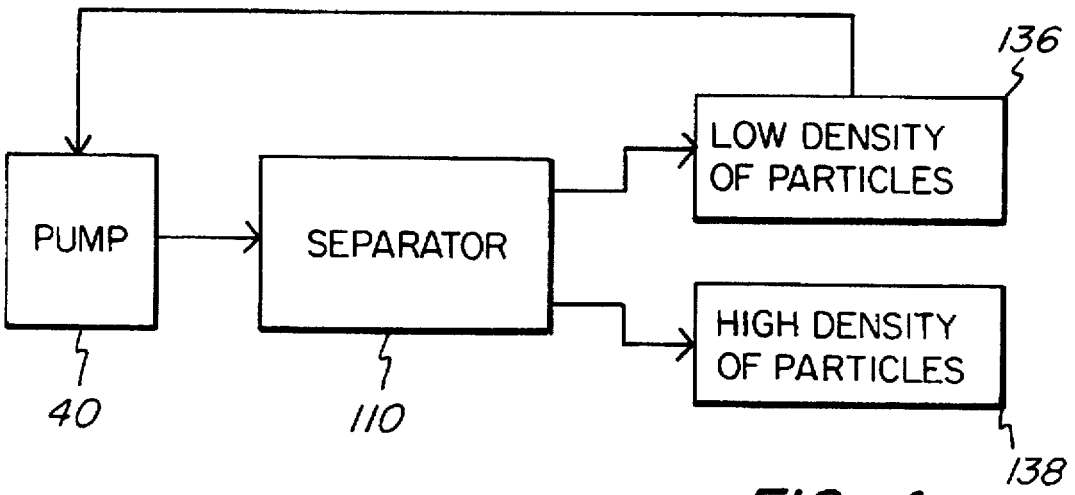
FIG. 4 is a block diagram illustrating the process of the present invention.

FIG. 4 is a block diagram schematically illustrating the present invention. A pump 40 is used to force material through the separator 110, which comprises a permanent magnet cylinder as illustrated in FIG. 1. A high density of particles 138 is collected near the higher magnetic flux density region in the magnetic field gradient. The low density of particles 136 is collected near the lower magnetic flux density region of the magnetic field gradient. The low density of particles 136 may be pumped back to the pump 40 for remixing with the material to be separated and input back into the separator 110. Additionally, several separators may be serially connected to obtain any desired density of particles at the output.

Accordingly, it should readily be appreciated that the particle separator of the present invention utilizes a permanent magnet structure having a magnetic field gradient for propelling particles to a region of higher magnetic flux within the gradient where they can be collected or output as desired. Accordingly, the present invention has many practical applications such as in mining for separating ore, or in medical applications for blood research and diagnosis.

While the present invention has been described with respect to the preferred embodiments, it will be readily appreciated to those skilled in the art that various modifications may be made without departing from the spirit and scope of this invention.

What is claimed is:

1. A particle separator comprising:

a permanent magnet tube, said permanent magnet tube having a transverse magnetic field with a magnetic field gradient from one surface to an opposing surface, said permanent magnet tube being formed from a plurality of permanent magnet sections wherein a magnetic orientation of each section varies linearly with a progression along an azimuthal coordinate angle as $\gamma=2\theta$, where $\gamma$ represents the desired angle of magnetic orientation and $\theta$ represents an angle between a central axis and a predetermined orientation angle;

a pump, said pump moving input material from one end of the magnetic tube to the other end; and an output at the other end of said magnetic tube, output collecting material having higher particle density than the input material.

2. A particle separator as in claim 1 further comprising:

a pipe placed within said permanent magnet tube.

3. A particle separator as in claim 2 further comprising: a transverse web placed longitudinally along a portion of said pipe near said output.

4. A particle separator as in claim 1 wherein: said permanent magnet tube is cylindrical.

5. A particle separator as in claim 4 wherein each of said plurality of sections extend radially from the central axis.

6. A particle separator as in claim 5 wherein: each of said plurality of segments has a remanence ranging from a maximum remanence to a minimum remanence.

7. A particle separator as in claim 6 wherein: the remanence varies from the maximum remanence to the minimum remanence with progression along a polar axis.

8. A particle separator as in claim 7 wherein: the remanence varies linearly with progression along the polar axis.

9. A magnetic particle separator comprising:

a plurality of permanent magnet segments forming a cylinder having a bore, each of said plurality of permanent magnet segments having a magnetic remanence and magnetic direction, the plurality of permanent magnet segments assembled such that the remanence of said plurality of permanent magnet segments increases from one surface of the cylinder to an opposing surface of the cylinder and the magnetic direction of each of said plurality of permanent magnets is rotated substantially uniformly from the one surface of the cylinder to the opposing surface of the cylinder wherein the magnetic direction of each segment varies linearly with a progression along an azimuthal coordinate angle as $\gamma=2\theta$, where $\theta$ represents the desired angle of magnetic direction and $\theta$ represents an angle between a central axis and a predetermined orientation angle so that a transverse magnetic field gradient having a higher magnetic field region and a lower magnetic field region is formed;

a pipe placed within the bore of the cylinder formed by said plurality of permanent magnet segments, said pipe having an input and an output end;

a divider placed transversely in said pipe near the output end, said divider separating the pipe longitudinally along a portion of its length into a high density opening near the higher magnetic field region and a low density opening near the lower magnetic field region;

a collector coupled to the higher density opening; and a pump coupled to the input end of said pipe, said pump forcing material longitudinally down the pipe.

* * * * *